US008393029B2

(12) United States Patent
Pichon et al.

(10) Patent No.: US 8,393,029 B2
(45) Date of Patent: Mar. 12, 2013

(54) APPARATUS FOR CLEANING A SUBMERGED SURFACE INCLUDING A BRUSHING DEVICE DRIVEN BY MEMBERS FOR DRIVING THE APPARATUS ON THE SUBMERGED SURFACE

(75) Inventors: Philippe Pichon, Villeneuve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 216 days.

(21) Appl. No.: 12/808,419

(22) PCT Filed: Dec. 17, 2008

(86) PCT No.: PCT/FR2008/052336

§ 371 (c)(1),
(2), (4) Date: Sep. 20, 2010

(87) PCT Pub. No.: WO2009/081036

PCT Pub. Date: Jul. 2, 2009

(65) Prior Publication Data

US 2011/0000030 A1 Jan. 6, 2011

(30) Foreign Application Priority Data

Dec. 21, 2007 (FR) ..... 07 08993

(51) Int. Cl.
*E04H 4/16* (2006.01)

(52) U.S. Cl. ..... 15/1.7; 210/167.16

(58) Field of Classification Search ..... 15/1.7, 15/388, 27, 41.1, 52.1; 210/167.1, 167.16, 210/167.17, 416.2, 459; 4/490, 496; 134/109, 134/110, 167 R, 168 R See application file for complete search history.

(56) References Cited

U.S. PATENT DOCUMENTS

| | | | | |
|---|---|---|---|---|
| 21,233 | A * | 8/1858 | Herrick | 15/41.1 |
| 3,097,383 | A * | 7/1963 | Taylor | 15/41.1 |
| 3,457,575 | A * | 7/1969 | Bienek | 15/41.1 |
| 3,822,754 | A | 7/1974 | Henkin et al. | |

(Continued)

FOREIGN PATENT DOCUMENTS

| | | |
|---|---|---|
| EP | 0565226 | 10/1993 |
| EP | 0750083 | 12/1996 |
| EP | 0905334 | 3/1999 |
| EP | 1785552 A2 * | 5/2007 |
| FR | 2729995 | 8/1996 |

OTHER PUBLICATIONS

International Search Report in Application No. PCT/FR2008/052336.

*Primary Examiner* — Monica Carter
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface including a body, members for driving this body over the immersed surface in a longitudinal direction, including a wheel, a device for brushing the immersed surface, a mechanism for rotating the brushing device about a brushing axis, wherein the driving mechanism of the brushing device includes: an internally toothed ring which is fixedly joined to a wheel, a brush pinion which is fixedly joined to the brushing device and which is engaged in the ring of this drive wheel in such a manner that a rotation of this drive wheel brings about a rotation of the brushing device about the brushing axis thereof in the same rotation direction.

7 Claims, 6 Drawing Sheets

U.S. PATENT DOCUMENTS 4,168,557 A 9/1979 Rasch et al.
5,337,434 A 8/1994 Erlich
2006/0225768 A1 10/2006 Erlich et al.
2007/0067930 A1* 3/2007 Garti ..... 15/1.7

* cited by examiner

APPARATUS FOR CLEANING A SUBMERGED SURFACE INCLUDING A BRUSHING DEVICE DRIVEN BY MEMBERS FOR DRIVING THE APPARATUS ON THE SUBMERGED SURFACE

CROSS REFERENCE TO RELATED APPLICATIONS

This application is the U.S. national phase of International Application No. PCT/FR2008/052336 filed on Dec. 17, 2008 and published on Jul. 2, 2009 as International Publication No. WO 2009/081036 A2, which application claims priority to French Patent Application No. 0708993 filed on Dec. 21, 2007, the entire contents of both of which are incorporated herein by reference.

The invention relates to a device for cleaning a surface which is immersed in a liquid, in particular a device for cleaning swimming pool walls.

Known swimming pool cleaning devices comprise:

a hollow body, members for guiding and driving this hollow body over the immersed surface in a main direction of advance, called the longitudinal direction.

These devices clean the immersed surface of a pool by drawing in debris present on this immersed surface. The debris are drawn into the region of a liquid inlet and filtered by a filtering device. The filtered liquid is returned to the pool via a liquid outlet.

In order to improve the cleaning of the immersed surface, a number of devices further comprise:

a device for brushing the immersed surface, mounted so as to rotate relative to the hollow body about a brushing axis, a mechanism for rotating the brushing device about the brushing axis thereof.

From these known devices, a number (cf., for example, EP 0 905 334) comprise separate members for driving the brushing device, that is to say, members which are independent of the members for driving the device over the immersed surface.

The members for driving the device over the immersed surface and the members for rotating the brushing device are heavy, have a large spatial requirement and consume energy. Consequently, such a device is large and heavy, which leads in particular to an increase in the hydraulic drag of this device.

There are other devices which comprise brushing devices which are directly rotated by the members for driving the device over the immersed surface. Of these devices, a number have driving members which comprise lateral chains (cf., for example, FR 2 729 995, U.S. Pat. No. 5,337,434, U.S. Pat. No. 4,168,557) which are capable of providing, on the one hand, the movement of the device over the immersed surface and, on the other hand, the rotation of the brushing devices.

Such devices do not allow easy maintenance. In particular, the replacement of a brushing device of such a device when it becomes worn, or in order to replace it with a device which is more suitable for the immersed surface to be cleaned or more suitable for the material of the immersed surface—liner, polyester, concrete, etc.—requires the driving members be disassembled, in particular the chains. This operation is complex and requires the involvement of a specialist technician.

Furthermore, these devices, owing to the existence of chains, do not allow the provision of a floor guard which prevents blockages of the device, for example, on a drainage plug of a swimming pool.

Furthermore, the contact surfaces between the chains and the immersed surface are extensive, which brings about significant losses of energy owing to friction and involves the use of powerful electric motors.

There are also devices which have driving members with motorized wheels (cf., for example, EP 0 565 226). These wheels have surfaces with occurrences of roughness distributed over the periphery of the wheel in such a manner that these wheels have a brushing function.

In practice, the brushing which is carried out by such devices is not very effective taking into account that it is carried out in the region of the lateral wheels of the robot in such a manner that the debris are projected towards the rear of the wheels and not towards the liquid inlet of the device which is generally arranged in a central portion of the base of the device.

Furthermore, the brushing is carried out at the rotation speed of the wheels, which does not allow the brushes to slide over the immersed surface and therefore limits the efficiency of the brushing operation.

However, driving by means of wheels is effective and allows a substantial floor guard to be provided.

Another disadvantage of the known devices is that the movement speed of the device over the immersed surface is dependent on the material from which the brushes are formed. In these known devices, a brush of hard material provides traction for the device but does not allow effective brushing since the brush is not very suitable for sliding over the immersed surface. Such a brush simply travels over the immersed surface. However, a brush of less hard material provides less traction but quickly becomes worn and requires regular replacement in order to maintain good brushing properties.

Consequently, in known devices, the selection of the material for the brushes must be determined in accordance with the type of pool to be cleaned, in particular in accordance with its physical properties, dimensional properties and properties for use, et cetera.

An object of the invention is to overcome these disadvantages and provide a device for cleaning an immersed surface which is able to combine the advantages of brush devices with independent driving with the advantages of wheeled driving devices, without nonetheless having the respective disadvantages thereof.

In particular, an object of the invention is to provide such a device which can both be driven by at least one wheel and comprise at least one device for brushing the immersed surface.

An object of the invention is also to provide a device for cleaning an immersed surface which comprises at least one brushing device which can be disassembled and which can be replaced independently of the wheels for driving the device over the immersed surface.

An object of the invention is also to provide such a device which does not involve the antinomic selection between a brush of hard material and a brush of soft material.

In particular, the invention relates to a device of the type whose movement speed over an immersed surface is independent of the material from which the brushing device is formed.

An object of the invention is also to provide a device of the type in which at least one brushing device is rotated by means of at least one driving wheel.

An object of the invention is also to provide a device of the type whose cost is reduced compared with known devices and whose levels of cleaning performance are equivalent or even improved.

The invention relates to any device for cleaning an immersed surface which may be driven in an electrical, hydraulic or mixed manner.

However, an object of the invention is more specifically to provide such a device of the type which is self-propelled with (an) on-board electric drive motor(s).

To this end, the invention relates to a device for cleaning an immersed surface comprising:

a hollow body, members for guiding and driving this hollow body over an immersed surface in a main direction of advance, called the longitudinal direction, comprising at least one wheel, at least one device for brushing the immersed surface, mounted so as to rotate relative to the hollow body about an axis, called the brushing axis, a mechanism for rotating a brushing device relative to the hollow body about the brushing axis thereof, wherein the driving mechanism of a brushing device comprises:

at least one internally toothed ring which is fixedly joined to a wheel, at least one pinion, called a brush pinion, which is engaged in a ring of a wheel and which is connected to the brushing device in such a manner that a rotation of this wheel in one direction brings about a rotation of the brush pinion and a rotation of the brushing device about the brushing axis in the same direction as the rotation direction of the wheel.

Such a device allows a brush to be driven by means of at least one wheel. By means of its fixedly joined toothed ring and the brush pinion, this wheel brings about the rotation of the brush about a brushing axis in the same direction as the rotation direction of the wheel. Such a device is therefore smaller and lighter than previous devices with brushes with driving members which are independent of the driving of the device over the immersed surface. The hydraulic drag of such a device according to the invention is therefore reduced compared with known devices.

The mechanism for rotating the brushing device of a device according to the invention is also more compact than the driving mechanisms of the prior art with the brush being driven directly by the wheel, which enables a gear mechanism or a belt to be dispensed with. Such a mechanism is simple and comprises a limited number of components.

Furthermore, a device according to the invention enables a constant speed to be ensured for the device over an immersed surface, regardless of the brushing device mounted on the device. In particular, a device according to the invention allows the function of driving the device to be disassociated from the function of brushing the immersed surface. The wheels provide the movement of the device over the immersed surface and the brushing device provides the brushing of the immersed surface by sliding over the immersed surface regardless of the speed of the brush and the material of the brushing device.

Furthermore, since the brushing device is rotated by means of a brush pinion which is engaged in an internally toothed ring, this brushing device can be disassembled without requiring the disassembly of all of the elements for driving the device over the immersed surface.

According to a first variant, the disassembly of the brushing device can be carried out by disassembling only one wheel from the device. According to another variant, the disassembly of the brushing device can be carried out by staggering the brushing device in such a manner that the brush pinion can be disengaged from the internally toothed ring.

Furthermore, such a wheeled device may have a substantial floor guard.

The wheel which is rotated by the members for guiding and driving the device over the immersed surface may be a drive wheel, that is to say, the driving members actuate the wheel directly which brings about the movement of the hollow body over the immersed surface—or a passive wheel—that is to say, the driving members bring about the movement of the hollow body over the immersed surface which brings about the rotation of the wheel which is rotatably mounted relative to the hollow body.

Advantageously and in accordance with the invention, at least one wheel for rotating a brushing device is a wheel for driving the hollow body over the immersed surface.

Such a drive wheel therefore initiates the movement of the hollow body of the device over the immersed surface to be cleaned.

The driving of the device over the immersed surface can be actuated by electrical means, hydraulic means, or a mixture of hydraulic and electrical means.

However, advantageously and according to the invention, the means for driving the hollow body over the immersed surface comprise:

at least one electric drive motor, at least one pinion, called a wheel pinion, which is engaged in an internally toothed ring of a drive wheel and which is capable of being rotated by means of an electric drive motor, in such a manner that this wheel pinion being caused to rotate by the electric motor brings about the rotation of this drive wheel.

The internally toothed ring which is fixedly joined to the wheel not only allows a rotation movement to be transmitted to the brush pinion which allows the brush to be rotated about the brushing axis, but also allows a driving rotation movement to be transmitted to the wheel itself, via the wheel pinion, which provides the movement of the device over the immersed surface.

Advantageously and according to the invention, each internally toothed ring which is fixedly joined to a wheel—drive or passive—is a peripheral ring with an internal toothed arrangement.

The transmission between an electric motor and the wheel pinion may comprise different pinions, belts or equivalent means.

However, advantageously and according to the invention, each wheel pinion is arranged at one end of a shaft, called the intermediate transmission shaft, comprising, at the end opposite the wheel pinion, a pinion which is called an intermediate pinion, which is engaged in a pinion, called a drive pinion, which is fixedly joined to the drive shaft of an electric drive motor.

Such a device comprises at least one electric motor whose drive shaft comprises at least one drive pinion. This drive pinion is engaged in an intermediate pinion which is fixedly joined to an intermediate shaft. This intermediate shaft comprises, at the end of the shaft opposite the intermediate pinion, the wheel pinion which is engaged in the internally toothed peripheral ring. The wheel pinion, the intermediate pinion, the intermediate shaft and the drive pinion form a transmission system which is capable of transmitting to the wheels a torque which allows the device to be moved over the immersed surface. The structure of this transmission system is such that the electric motor rotates the drive shaft in the opposite direction to the rotation direction of the wheels. The intermediate pinion allows a conventional electric DC motor to be used, for example, a brush motor which has a rotation speed of approximately 120 rpm which develops a power of less than 5 W.

A device according to the invention therefore consumes little energy.

Preferably, the drive shaft, the intermediate shaft and the drive axle are parallel and extend in a direction, called the transverse direction, perpendicular relative to the longitudinal direction.

Advantageously and according to the invention, the members for driving the device over the immersed surface comprise two parallel axles which extend in the transverse direction, each axle comprising at least two wheels which are arranged at each of the transverse ends of the axle, respectively, at least one of the axles comprising at least one drive wheel.

According to one variant of the invention, the two parallel axles are drive axles which comprise at least two drive wheels which are arranged at each of the transverse ends of this axle, respectively.

According to this variant, each drive wheel is advantageously provided with an internally toothed ring which is capable of being rotated by means of a wheel pinion, which is in turn rotated by means of an intermediate shaft which is itself rotated by means of a drive pinion which is mounted on the drive shaft of an electric motor.

According to another variant of the invention, the members for driving the device over the immersed surface comprise a single drive axle.

Advantageously and according to the invention, each drive wheel of each drive axle is a non-guiding wheel with an internal toothed arrangement.

The absence of guiding wheels on the drive axle allows an axle to be provided whose production is facilitated owing to the absence of guiding members, such as steering journals. A device comprising such an axle is therefore economical to produce. Furthermore, an axle with non-guiding wheels is robust.

According to an advantageous variant of the invention, the device comprises two axles, a front drive axle which comprises non-guiding wheels to which the internally toothed rings are fixed and which are capable of driving, via brush pinions, a brush for cleaning the immersed surface which extends between these two wheels, and a rear non-drive axle which comprises non-guiding wheels.

According to a variant of the invention, the rear axle may also comprise a brushing device which is rotated about a transverse axis by the wheels of the rear axle.

According to another variant, only the front axle comprises a brushing device.

A brushing device according to the invention may have different shapes and structures.

Advantageously, however, and according to the invention, each brushing device is formed by at least one brush which comprises a central core which extends in the transverse direction and a plurality of fins which extend radially from the central core and parallel with the transverse direction.

The fins of the brush can be produced from different materials, in particular from rubber, a thermoplastic material or generally from a material which has elastic strain in terms of compression and flexion when the fin comes into contact with the immersed surface in order to allow the rotation of the brush and allow debris which are lodged on the immersed surface to be moved towards the liquid inlet which is provided at the base of the body of the device.

Advantageously and according to the invention, the brushing device comprises two coaxial brushes, each brush being coupled to a wheel.

Advantageously and according to the invention, each wheel pinion has a pitch and diameter which are identical to the pitch and diameter of each brush pinion.

Advantageously and according to the invention, the brushing device has a smaller diameter than the diameter of the wheel which is fixedly joined to the ring in which the brush pinion which rotates it is engaged.

Such a device thus has a configuration in which the rotation speed of the brushing device about the brushing axis thereof is greater than the rotation speed of the wheels.

Advantageously, a device according to the invention further comprises a filtration chamber which is provided in the hollow body of the device and which has:

- at least one liquid inlet into the hollow body, located at the base of the body,
- at least one liquid outlet out of the hollow body, located remotely from the base of the body,
- at least one hydraulic circuit which is capable of providing a flow of liquid between at least one liquid inlet and at least one liquid outlet through at least one filtering device, under the action of a pumping device.

Advantageously and according to the invention, the brushing device is arranged at a longitudinal end of the hollow body and extends in a direction, called the transverse direction, perpendicular relative to the longitudinal direction, in such a manner that the brushing axis extends in the transverse direction.

Advantageously and according to the invention, the brushing device is connected to the hollow body in such a manner that the device rests on the immersed surface, in the region of the longitudinal end where the brushing device is arranged, substantially on the brushing device.

Advantageously and according to the invention, the hollow body is formed principally by a concave housing which delimits a main chamber, this housing having openings which are provided at the base of the housing and at the rear of the housing, respectively, these openings forming each liquid inlet and each liquid outlet, respectively.

The invention further relates to a device for cleaning an immersed surface, characterized in combination by all or some of the features mentioned above or below.

Other features, objectives and advantages of the invention will be appreciated from a reading of the following description, which sets out by way of non-limiting example an embodiment of the invention with reference to the appended drawings, in which.

In the Figures, the scales and the proportions have not been strictly complied with, for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear of the device are defined.

Figure 1:
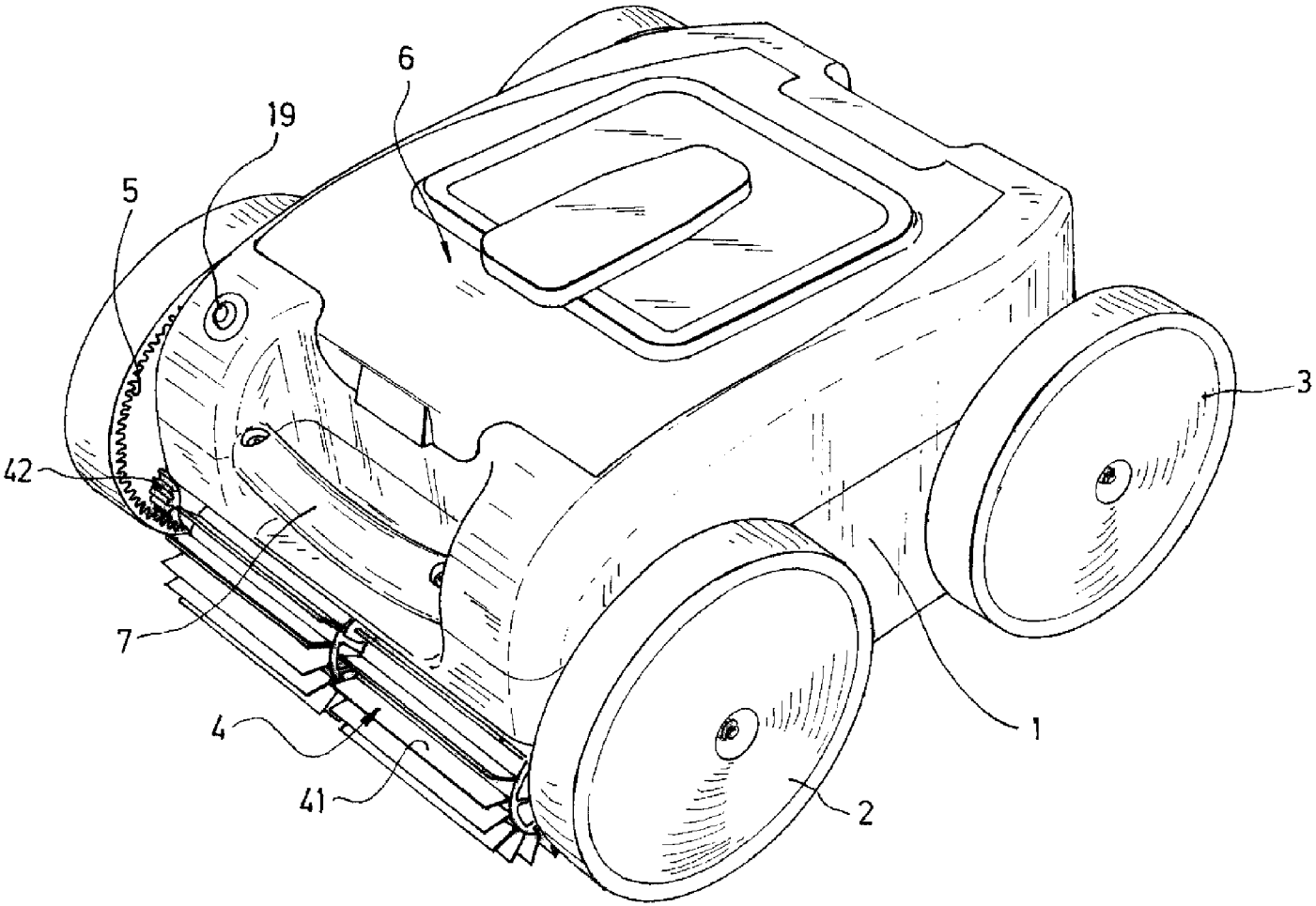
FIG. 1 is a schematic perspective plan view of a cleaning device according to an embodiment of the invention.
Figure 2:
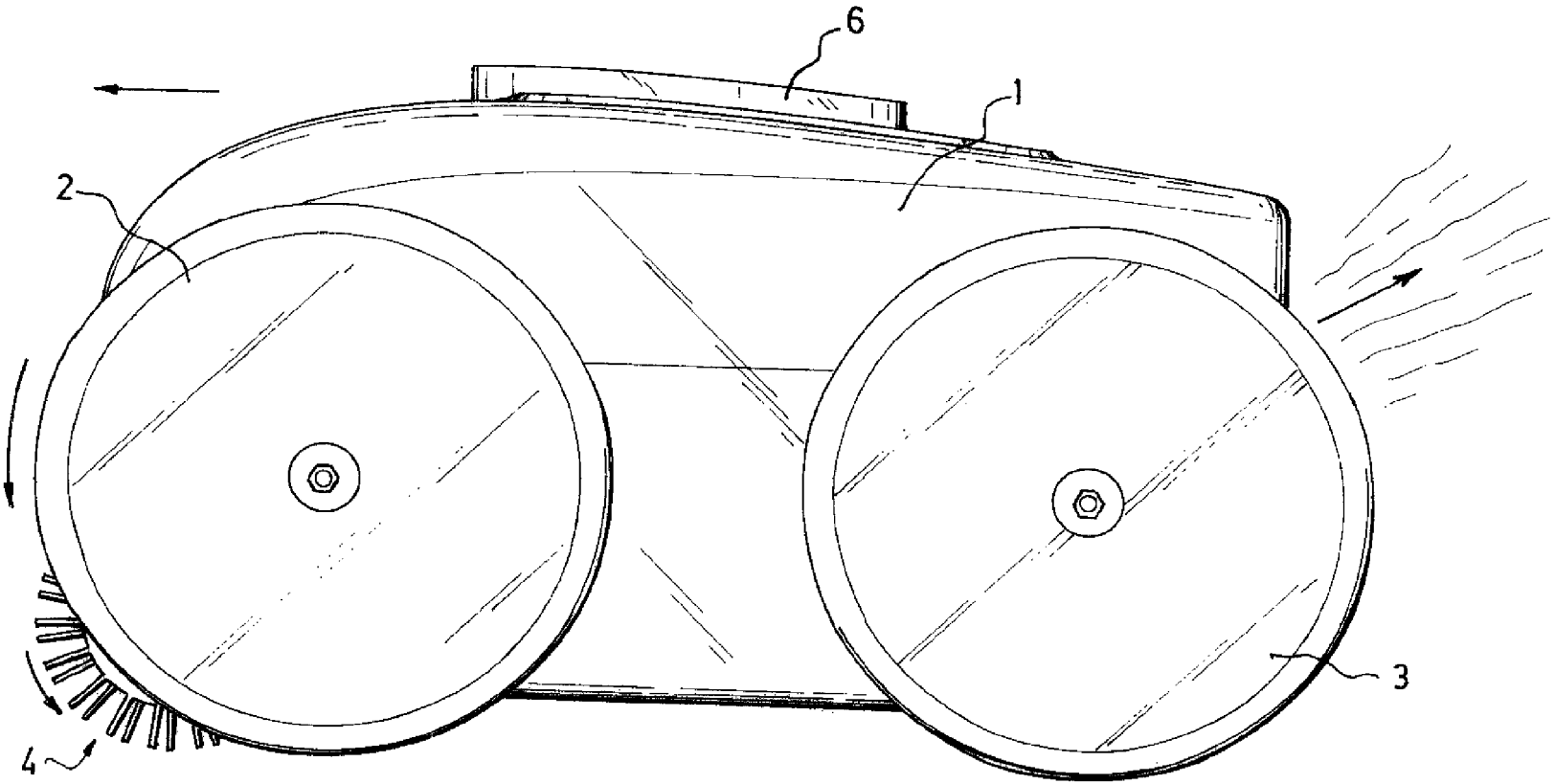
FIG. 2 is a schematic side view of a cleaning device according to an embodiment of the invention.
Figure 5:
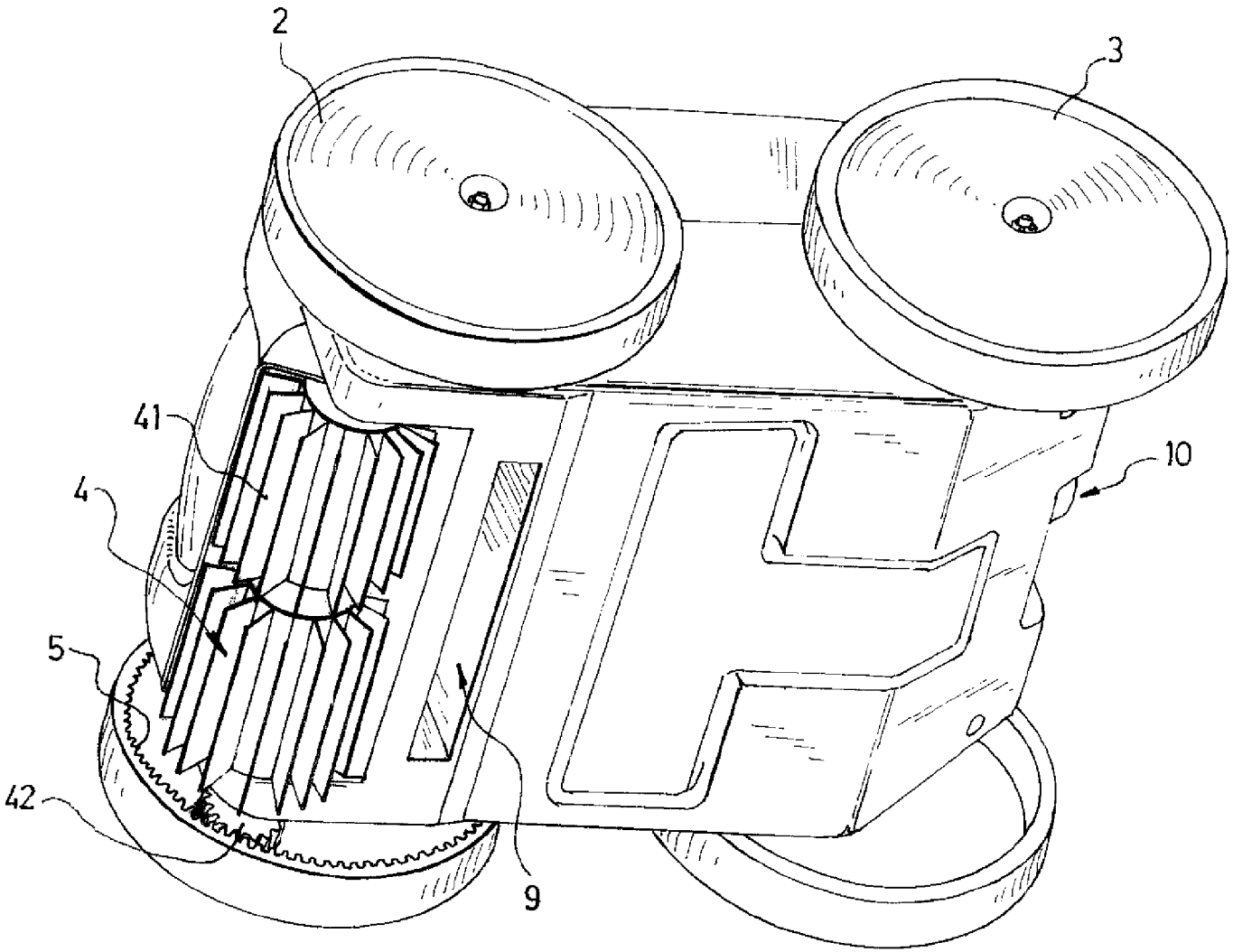
FIG. 5 is a schematic perspective bottom view of a cleaning device according to an embodiment of the invention.

A device according to the invention comprises, as illustrated in particular in FIGS. 1, 2 and 5, a hollow body 1 and rolling members 2, 3, 4 for guiding and driving the hollow body 1 over an immersed surface in at least one preferred direction of advance and in a main direction of advance, called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber which is capable of receiving a filtration chamber. This central chamber is delimited by a lower wall which extends in a substantially horizontal plane; by lateral walls which extend generally in vertical planes; by a front wall which extends generally in a vertical plane which is orthogonal relative to the planes of the vertical lateral walls; and by a rear wall which extends generally in a vertical plane orthogonal relative to the planes of the vertical lateral walls.

The lower wall has an opening which extends transversely in the region of the front wall so that liquid is able to return to the central chamber via this lower transverse opening. This opening forms a liquid inlet 9 in the hollow body 1.

The rear wall comprises a cylindrical opening which forms a liquid outlet 10 out of the hollow body 1. This liquid outlet 10 which is provided in the rear wall of the housing is longitudinally offset from the liquid inlet 9 which is provided in the lower wall. Furthermore, this liquid outlet 10 is provided in the upper portion of the housing so that it is also vertically offset from the liquid inlet 9.

Figure 3:
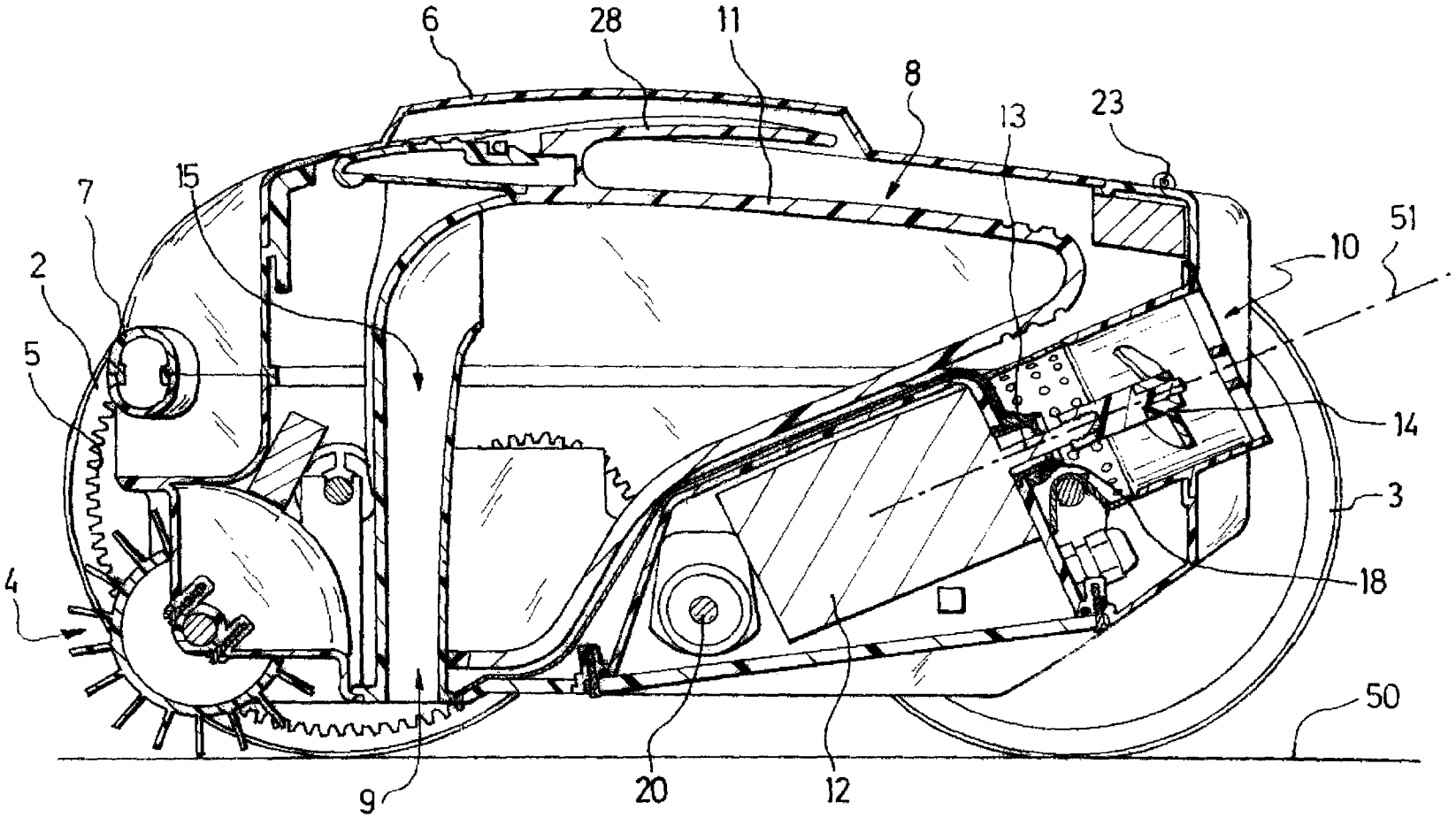
FIG. 3 is a schematic section of a cleaning device according to an embodiment of the invention.
Figure 4:
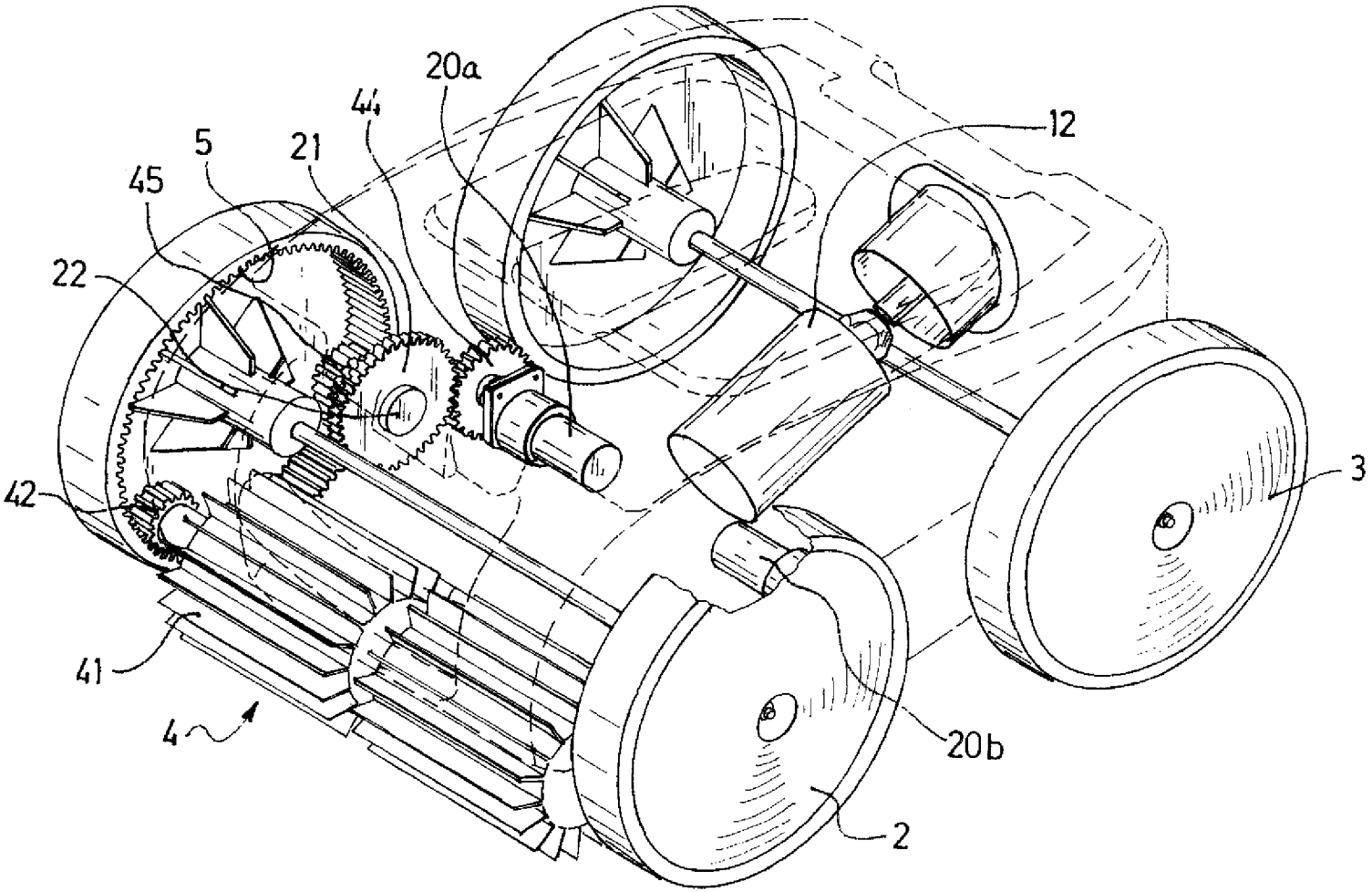
FIG. 4 is a schematic perspective view of the mechanism for driving the brushing device by the wheels of the device according to an embodiment of the invention.

As illustrated in particular in FIG. 3, this central chamber, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

The transverse opening provided in the lower wall of the housing forms the liquid inlet 9 of the device and the cylindrical opening provided in the rear wall of the device forms the liquid outlet 10 of the device.

Preferably, the liquid inlet 9 and the liquid outlet 10 are offset longitudinally but are both centered on the same longitudinal vertical center plane of the device.

The central chamber of the hollow body 1 is capable of receiving a filtering device 11. The filtering device 11 is arranged between the liquid inlet 9 and the liquid outlet 10.

This filtering device 11 may be of any known type.

For example, the filtering device 11 comprises a rigid frame and a filtering sheet—in particular a filtering material—carried by this rigid frame. Such a filtering device 11 is therefore self-supporting and can be readily handled by a user.

The device also comprises a flap 6 for access to this filtering device. This access flap 6 forms an upper wall of the hollow body 1 and covers it. In the embodiment illustrated, this flap 6 is provided on the upper portion of the device so that a person using the device can readily open the flap 6 and remove the filtering device 11. Preferably, the access flap 6 is articulated to the body 1 of the device by means of hinges 23 which are provided at the rear of the device.

Preferably, the filtering device 11 is a device which is mounted in the central chamber in the manner of a drawer. To this end, the rigid frame of the filtering device 11 has two ribs which extend laterally from each side of the filtering device 11. These ribs have shapes and dimensions which correspond to and complement the shapes and dimensions of grooves which are fixedly joined to the hollow body 1. These grooves which are fixedly joined to the hollow body 1 extend vertically along the inner faces of the vertical lateral walls of the hollow body 1. The ribs of the filtering device 11 are therefore capable of co-operating with the grooves of the hollow body 1 of the device.

In this manner, the removal of the filtering device 11 is the result of a translation movement of the filtering device 11 along the grooves of the hollow body 1. A user can therefore readily remove the filtering device 11 from the hollow body 1 in order, for example, to clean it. After the filtering device 11 has been cleaned, a user can readily reintroduce the filtering device 11 into the hollow body 1 by orientating the filtering device 11 so that the ribs of the filtering device 11 are opposite the grooves of the hollow body, then by sliding the filtering device 11 into the hollow body 1.

The filtering device 11 further comprises a handle 28 which is provided on an upper portion of the filtering device 11 in order to facilitate handling of the filtering device 11.

Preferably, a device comprises a motorized liquid pumping device which comprises a pumping motor 12 which has a rotating drive shaft 13 which is coupled to a pumping propeller 14 which is interposed in the hydraulic circuit in order to generate a flow of liquid between the liquid inlet 9 and the liquid outlet 10. The liquid outlet 10 is directly opposite the pumping propeller so that the liquid flows out of the liquid outlet 10 in a direction which corresponds to the liquid flow generated by the pumping propeller, this flow having a speed which is orientated in accordance with the rotation axis 51 of the propeller 14.

The pumping propeller 14 has an orientation which allows a flow of liquid to be generated with a horizontal component towards the rear.

Preferably, the pumping propeller 14 which is interposed in the hydraulic circuit between the liquid inlet 9 and liquid outlet 10 has an inclined rotation axis which forms, with the longitudinal direction and with the theoretical rolling plane 50, an angle $\alpha$ which is not equal to 90°. This propeller 14 is rotated by an electric pumping motor 12 which preferably has a rotating drive shaft 13 parallel with the rotation axis of the propeller 14.

According to the invention, the electric pumping motor 12 is arranged below the hydraulic circuit entirely at the outer side of this hydraulic circuit which completely bypasses the pumping motor 12 at the top. The rotating shaft 13 of the pumping motor 12 extends through an inclined lower wall which delimits the hydraulic circuit. The sealing is provided by an O-ring 18.

Figure 6:
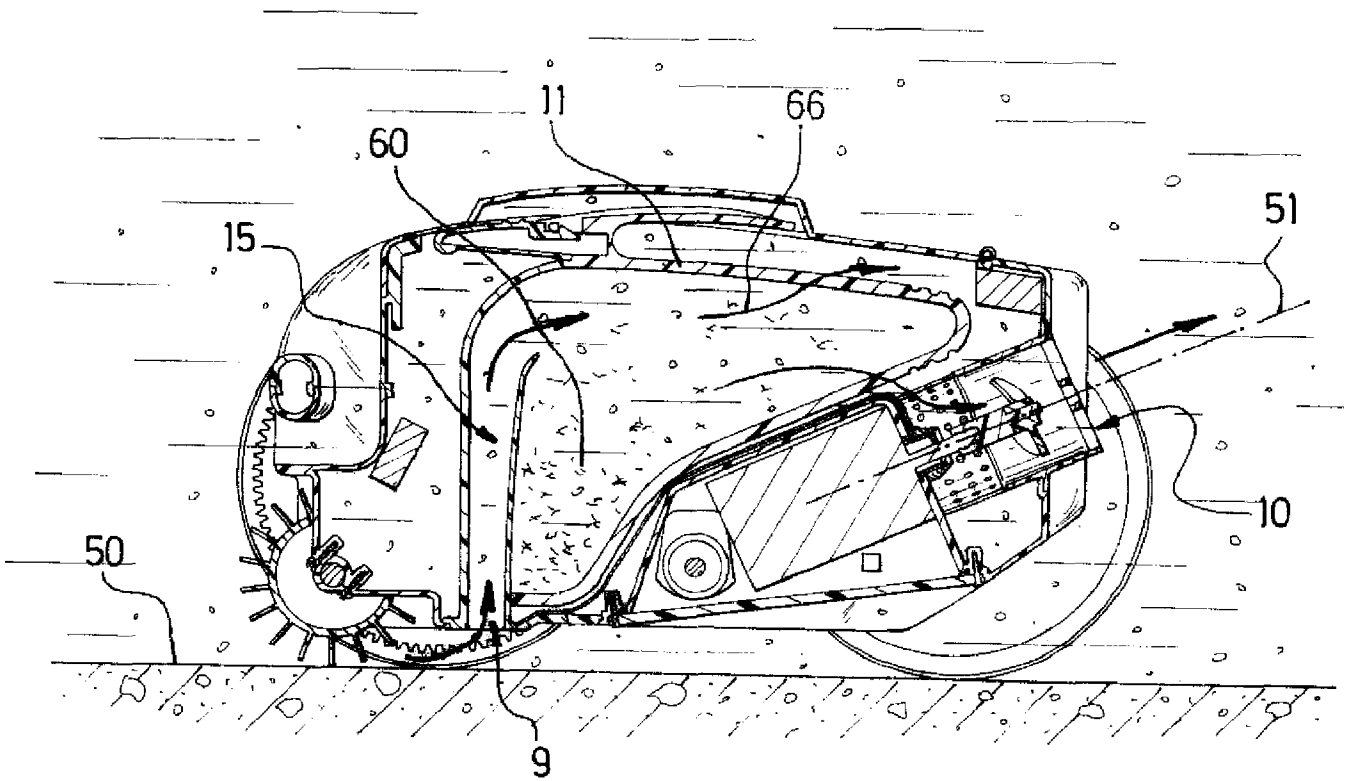
FIG. 6 is a simplified schematic section of FIG. 3 illustrating the device during operation over an immersed surface.

FIG. 6 illustrates the flow of liquid in the hollow body 1 of the device. This flow is illustrated schematically in FIG. 6 by means of arrows 66. Liquid enters the hollow body 1 via the liquid inlet 9 which is arranged below the device. This liquid passes into a liquid inlet column 15 in order to reach the filtering device 11. This filtering device 11 allows the liquid to pass through the filtering material and retains the solid debris 60. The filtered liquid reaches the liquid outlet 10 and is discharged at the rear of the device into the pool from which it originates.

Since the liquid outlet 10 is opposite the pumping propeller 14, the liquid flows out of the device via this outlet with a speed V which is orientated in accordance with the axis 51 of the pumping propeller 14 and which has a longitudinal component towards the rear which brings about, by means of reaction, forces whose resultant has a longitudinal drive component which is orientated towards the front and which is involved in driving the device over the immersed surface.

The orientation of the hydraulic reaction force created by the discharge flow and therefore the size of the longitudinal component thereof are dependent on the inclination a relative to the theoretical rolling plane 50, the rotation axis 51 of the propeller and the liquid outlet 10. Preferably, this inclination $\alpha$ is between 15° and 45°.

Preferably, the pumping motor is arranged below the hydraulic circuit, entirely outside this hydraulic circuit, in such a manner that the filtering device 11 of the hydraulic circuit can be removed from the device at the top of the device as mentioned above, without being impeded by the pumping motor. Only the pumping propeller 14 is arranged in the hydraulic circuit in order to be able to provide the flow of liquid. This pumping propeller 14 is arranged at the rear of the device, close to the liquid outlet 10. That is to say, the pumping propeller 14 and the liquid outlet 10 form the end portion of the hydraulic circuit.

In the preferred embodiment of the invention illustrated in the Figures, the rolling members for guiding and driving the device comprise a front axle which comprises front drive wheels 2, one at each side, and a rear axle which comprises rear non-drive wheels 3, one at each side.

The device further comprises at least one electric motor 20 for driving the front drive wheels 2. Preferably, the device comprises two drive motors 20*a*, 20*b*, one at each side, respectively, for independently driving each of the front wheels 2. To this end, each front wheel 2 has a peripheral ring 5 which has an internal toothed arrangement and which is fixedly joined to this wheel 2.

According to the embodiment in the Figures, the device comprises two coaxial front brushes 4 which are in continuation of each other in one direction, called the transverse direction, perpendicular relative to the longitudinal direction. Each brush 4 is capable of being caused to rotate about an axis which extends in the transverse direction by a wheel 2. Each brush 4 comprises a plurality of fins 41 which extend radially from a brush shaft which forms the rotation axis of the brush 4. The fins 41 are, for example, of rubber or a strong plastics material.

The brushes 4 are rotated by at least one electric motor 20*a*, 20*b* for driving the front wheels 2 via the wheels 2 and a gear system.

Each electric motor 20*a*, 20*b* comprises a drive shaft which comprises a drive pinion 44. This drive pinion 44 is engaged in an intermediate pinion 21 which is fixedly joined to an intermediate shaft 22. This intermediate shaft 22 comprises, at the end of the shaft opposite the intermediate pinion 21, a wheel pinion 45 which is engaged in the internally toothed peripheral ring 5. The wheel pinion 45, the intermediate pinion 21, the intermediate shaft 22 and each drive pinion 44 form a transmission system which is capable of transmitting to the wheels 2 a torque which allows the device to be moved over the immersed surface. The structure of this transmission system is such that each electric motor 20*a*, 20*b* rotates a drive shaft in an opposite direction to the rotation direction of the wheels 2.

That is to say, the internally toothed peripheral ring 5 of each front drive wheel 2 co-operates with a brush pinion 42 which is fixed to one end of the shaft of a brush 4 in such a manner that a rotation of the wheel 2 brings about, by means of the internally toothed ring 5 and the brush pinion 42, the rotation of the shaft of the brush 4 and therefore the rotation of the brush 4.

The various pinions of the transmission system may be pinions which have regular tooth arrangements or helical tooth arrangements.

Preferably, the wheel pinion 45 and the internally toothed peripheral ring 5 are produced from a thermoplastic material which is water-resistant. These pinions may be, for example, produced from Delrin®, Nylon®, or an equivalent material. According to the embodiment of the Figures, the peripheral ring 5 comprises 94 teeth and the wheel pinion 45 has seventeen teeth so that the step-down ratio is in the order of 5. According to the embodiment of the Figures, the brush pinion 42 is identical to the wheel pinion 45.

Preferably, each brush 4 has an outer diameter of between 40 mm and 200 mm. According to the embodiment of the Figures, the brush 4 has an outer diameter of approximately 100 mm. According to this embodiment, the brush 4 has during operation an outer diameter of approximately 100 mm whilst, in the idle state, it has a diameter of approximately 102 mm. This is explained by the fact that the brush 4 has a structure which is flexible in terms of compression so that it is slightly crushed during the operation of the device and provides effective brushing of the immersed surface.

The electric motors 20*a*, 20*b* and the pumping motor 12 may be of any known type. According to a preferred embodiment, these electric motors are low-voltage motors. They may be supplied by an electrical power supply which is external to the device via an electrical cable which is not illustrated in the Figures and which is connected to the device in the region of a zone 19 for introducing the electrical cable into the device, as illustrated in FIG. 1.

According to the embodiment illustrated in the Figures, the rolling members are constituted by the front drive wheels 2, rear non-drive wheels 3 and brushes 4 which are involved in driving and guiding the device over the immersed surface. The rolling members 2, 3, 4 have zones which are intended to come into contact with the immersed surface and which are co-planar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these wheels facilitate the passing of obstacles and have improved traction. Advantageously, their peripheral tread is formed by or covered with a non-skid material.

The front wheels 2 and the brushes 4 constitute front drive members which protrude forwards relative to the other constituent elements of the device, in particular the hollow body, in order to form the extreme front portion of the device and first come into contact with an obstacle which is encountered during forward movement.

Furthermore, according to a preferred embodiment of the invention, the device also comprises an operating handle 7 which allows a user to carry the device in order to immerse it in a liquid and to remove it therefrom. This handle 7 is preferably arranged opposite the liquid outlet 10 so that, when the hollow body 1 is suspended by this handle, the device tilts spontaneously under the effect of gravity into a position in which the liquid outlet 10 is located below the liquid inlet 9 which allows the device to be emptied. When the device moves from the cleaning position to the emptying position, the debris drawn in by the device are retained in the filtering device and cannot be discharged from the device.

Of course, the invention may involve numerous construction variants and applications.

For example, according to an embodiment which is not illustrated in the Figures, the pinions may have different original diameters, pitches and numbers of teeth.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner adapted to travel along an immersed surface and comprising:

a. a body comprising (i) an inlet and (ii) an outlet separate from the inlet;

b. a pumping device configured to cause water to flow from the inlet to the outlet;

c. a wheel configured for rotation and having an internally toothed ring;

d. a brush assembly (i) configured to contact the immersed, surface and (ii) comprising a brush and a shaft about which the brush rotates; and e. a pinion engaging the internally toothed ring and connected to the shaft so that rotation of the wheel in a first direction causes rotation of the pinion and the brush in the first direction.

2. A swimming pool cleaner according to claim 1 further comprising a filtering device positioned between the inlet and the outlet and through which water may flow under action of the pumping device.

3. A swimming pool cleaner according to claim 1 further comprising (a) an electric motor and (b) a wheel pinion engaging the internally toothed ring and configured to be rotated under action of the electric motor.

4. A swimming pool cleaner according to claim 3 in which the electric motor comprises a drive shaft, further comprising (a) a drive pinion connected to the drive shaft and (b) an intermediate pinion engaging the drive pinion.

5. A swimming pool cleaner according to claim 4 further comprising an intermediate transmission shaft to which both of the intermediate and wheel pinions are connected.

6. A swimming pool cleaner according to claim 3 in which each of the brush pinion and the wheel pinion has a pitch and a diameter, the pitches of the brush and wheel pinions being identical and the diameters of the brush and wheel pinions being identical.

7. A swimming pool cleaner according to claim 1 in which the body defines a forwardmost portion and the wheel extends forward of the forwardmost portion.

* * * * *